US008328702B2

(12) United States Patent
Reyes

(10) Patent No.: US 8,328,702 B2
(45) Date of Patent: Dec. 11, 2012

(54) LOWER BACK MACHINE AND METHOD OF TRAINING THEREFOR

(75) Inventor: Gil Reyes, Las Vegas, NV (US)

(73) Assignee: GRAA Innovations, LLC, Las Vegas, NV (US)

( * ) Notice: Subject to any disclaimer, the term of this patent is extended or adjusted under 35 U.S.C. 154(b) by 0 days.

(21) Appl. No.: 12/731,303

(22) Filed: Mar. 25, 2010

(65) Prior Publication Data

US 2011/0237406 A1 Sep. 29, 2011

(51) Int. Cl.
*A63B 21/00* (2006.01)

(52) U.S. Cl. ..... 482/130; 482/907; 482/142

(58) Field of Classification Search ..... 482/142, 482/130, 140
See application file for complete search history.

(56) References Cited

U.S. PATENT DOCUMENTS

| | | | | |
|---|---|---|---|---|
| 3,465,750 | A | | 9/1969 | Schawalder |
| 3,602,501 | A | | 8/1971 | Garner |
| 3,709,488 | A | | 1/1973 | Garner |
| 4,004,801 | A | | 1/1977 | Campanaro et al. |
| 4,149,715 | A | | 4/1979 | Kusmer |
| 4,208,049 | A | | 6/1980 | Wilson |
| 4,500,089 | A | | 2/1985 | Jones |
| 4,711,448 | A | | 12/1987 | Minkow et al. |
| 4,725,056 | A | | 2/1988 | Rehrl et al. |
| 4,796,881 | A | | 1/1989 | Watterson |
| 4,836,536 | A | | 6/1989 | Jones |
| 4,915,378 | A | | 4/1990 | Abrahamian et al. |
| 5,056,779 | A | | 10/1991 | Webb |
| 5,190,513 | A | | 3/1993 | Habing et al. |
| 5,267,930 | A | * | 12/1993 | Henes ..... 482/139 |
| 5,665,041 | A | | 9/1997 | Hsieh |
| 5,800,310 | A | | 9/1998 | Jones |
| 5,800,321 | A | | 9/1998 | Webber |
| 5,938,575 | A | | 8/1999 | Stearns |
| 6,244,995 | B1 | | 6/2001 | Prsala |
| 6,478,721 | B1 | | 11/2002 | Hunter |
| 6,482,134 | B1 | | 11/2002 | Rasmussen |
| 6,634,996 | B2 | | 10/2003 | Jacobsen |

(Continued)

FOREIGN PATENT DOCUMENTS

KR 20-1993-0000525 Y1 2/1993

(Continued)

OTHER PUBLICATIONS

Op. of Int'l Search. Auth, p. 3.

*Primary Examiner* — Jerome W Donnelly
(74) *Attorney, Agent, or Firm* — Jones Day

(57) ABSTRACT

A lower back machine provides highly effective lower back and core training while protecting a user's body, namely the user's back, from injury. The machine may comprise a brace to prevent the user from overextending the user's back and a resistance device to provide a resistance to the user. The resistance may be at various force vectors directed forward from the user. To train, the user may move to a bent position over the brace while grasping the resistance device. The user may then move to a standing position by rotating the upper body over the brace while moving the lower body towards the brace. Contact with the brace in the standing position prevents overextension of the user's back. The machine may comprise one or more foot supports to secure the user's footing during training and one or more stops to prevent excessive leaning in the bent position.

3 Claims, 6 Drawing Sheets

U.S. PATENT DOCUMENTS

| | | | | |
|---|---|---|---|---|
| 6,896,643 | B2 | 5/2005 | Durfee, Jr. | |
| 7,247,128 | B2 | 7/2007 | Oga | |
| 7,887,472 | B2 | 2/2011 | Pandozy | |
| 7,981,010 | B1 * | 7/2011 | Webber et al. | 482/96 |
| 2006/0100070 | A1 | 5/2006 | Abdo | |
| 2006/0160677 | A1 | 7/2006 | Piane, Jr. | |

FOREIGN PATENT DOCUMENTS

| | | | |
|---|---|---|---|
| KR | 20-0324294 | Y1 | 8/2003 |
| KR | 10-2006-0070661 | A | 6/2006 |

* cited by examiner 156
124
120
160A
184
140
128
148
136
180
160A
144
176
104
112

LOWER BACK MACHINE AND METHOD OF TRAINING THEREFOR

BACKGROUND OF THE INVENTION

1. Field of the Invention

The invention relates to exercise equipment and in particular to a lower back exercise machine and method of training on the exercise machine.

2. Related Art

Traditionally, lower back exercises have been used to strengthen and tone the muscles of the lower back and core. This is highly beneficial in increasing mobility and flexibility in athletics as well as in everyday activities. In addition, a strong lower back and core help prevent or reduce back pain as a person can better support him or herself with the added strength.

Traditional back devices such as a roman chair allow a user to exercise his or her lower back. In general, while positioned horizontally, the user lifts and lowers the upper body with his or her lower back muscles. The user's own weight is typically used as resistance. In addition, for a large portion of time, the user's upper body is tilted downward causing blood to rush toward the user's head. It is the user's responsibility to utilize proper technique to prevent injury to him or herself while exercising on such devices.

From the discussion that follows, it will become apparent that the present invention addresses the deficiencies associated with the prior art while providing numerous additional advantages and benefits not contemplated or possible with prior art constructions.

SUMMARY OF THE INVENTION

A lower back machine for lower back and core training is disclosed herein.

The lower back machine permits a user to safely train his or her core and lower back (and other associated muscles and body structures) while reducing or eliminating the risk of injury due to overextension of the user's back. The lower back machine also provides a unique resistance for such training which also stretches the users back during training. This is advantageous in strengthening and toning the lower back and core as well as relieving back pain, among other things.

The lower back machine may be configured in various ways. In one embodiment, the lower back machine comprises a frame having a front and back portion, and a brace configured to accept contact from a waist area of a user to prevent overextension of the user's back. The brace may have a front side and a back side with the back side configured to accept user contact. An extension may extend forward of the front side of the brace. At least one resistance device may be included to provide a resistance having a force vector directed forward from the user. It is contemplated that the extension may be configured to support at least a portion of the at least one resistance device at a location below the user's lower back to generate a force vector directed forward from the user at a downward angle.

One or more foot supports at a base portion of the brace may be provided as well to secure the user's footing during training. The lower back machine may also include one or more stops supported by the frame. The stops may be located behind the one or more foot supports. The stops may have a height configured to accept contact from a rear portion of the user. For example, the stops may contact a back portion of one or more legs, a back portion of one or more thighs, a posterior, and/or one or more ankles of the user.

A variety of resistance devices may be used with the lower back machine. For example, a resistance device may be a weight stack at a rear portion of the lower back machine. A resistance device may also be a variable resistance device such as at least one spring, at least one elastic band, or both. The lower body machine may include one or more pulleys and a cable to transfer the resistance to the user. To illustrate, the cable may be attached at a first end to the at least one resistance device to transfer resistance to the user. The one or more pulleys may be configured to locate a second end of the cable in front of the user to present the resistance along a desired force vector.

In another embodiment, the lower back machine may comprise a brace at a front portion of the lower back machine. The brace may be configured to accept contact from a front portion of a user to prevent overextension of the user's back. One or more supports extending upward from the frame may be included to support the brace at an elevated position to accept contact from the user's waist area. The one or more supports may be configured to raise and lower the brace.

The lower back machine may also include a resistance device configured to provide a resistance to the user along one or more force vectors, and an extension extending forward at the front portion of the lower back machine. The extension may be configured to support at least a portion of the resistance device in front of the brace. It is contemplated that the extension may be configured to extend and retract at the front portion of the lower back machine to accommodate one or more users with varying arm lengths. The brace and the extension may be supported by a frame.

The lower back machine may include or more foot supports below the brace that may be angled downward towards a back portion of the lower back machine. In addition, one or more stops may be provided to accept contact from a rear portion of a user. Like the above embodiment, the stops may have a height configured to accept contact from a rear portion of the user, such as a back portion of one or more legs, a back portion of one or more thighs, a back portion a posterior, and/or one or more ankles of the user.

A method of training on a lower back machine using a lower body and an upper body of a user is also provided herein. In one embodiment, the method may comprise engaging a resistance device at a front portion of the lower back machine by grasping a handle of the resistance device, bending the upper body forward over a brace of the lower back machine and leaning the lower body backward while resisting the resistance, and raising the upper body backward over the brace and moving the lower body towards the brace while overcoming the resistance. The lower body may be moved towards the brace until contact with the brace is made. It is contemplated that a lower back portion of the upper body may be stretched while bending the upper body forward over a brace of the lower back machine and leaning the lower body backward. The user may hold this position for a predetermined period of time to increase stretching time. This stretching beneficial in that it improves flexibility and reduces back pain.

Contact with the base prevents overextension of the user's back. In addition, the user may come into contact with one or more stops with a rear portion of the user's lower body as the lower body is leaned backward. It is noted that the resistance device may be configured to generate a resistance at a force vector directed forward from the user.

The user may step on one or more foot supports configured to secure the user's footing while the user is resisting the resistance and overcoming the resistance. The user's arms may be extended while engaged to the resistance device. In this manner, the one or more arms are extended while the user is resisting the resistance and overcoming the resistance. It is contemplated that the length of an extension of the lower back machine may be extended to accommodate a length of one or more arms of the user.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION OF THE PREFERRED EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Lower back exercises are helpful in strengthening a user's core or torso. Muscles and body structures (such as bones, tendons, and ligaments) of the core are used in everyday tasks, such as standing, running, lifting, and walking. Indeed virtually every motion of a user's arms and legs are supported by the user's core. In physical activities such as sports a strong core is highly advantageous to speed, power, and mobility.

Exercising the user's core also has other benefits. For example, strong core muscles may reduce or eliminate back pain such as by strengthening the muscles of a user's back to better support the user. In addition, a user may improve his or her appearance at the waistline through core exercises.

The lower back machine herein is uniquely configured to allow lower back exercises to be performed safely and with improved effectiveness. As will be described further below the lower back machine is configured to prevent a user from over extending his or her back during training. This is in contrast to traditional exercise devices which rely upon the user to prevent injury. In addition, the lower back machine provides a resistance to the user to enhance lower back exercises performed on the machine. Moreover, the lower back machine allows highly effective lower back exercises to be performed while reducing strain, such as compression, on the user's back and spine.

Figure 1A:
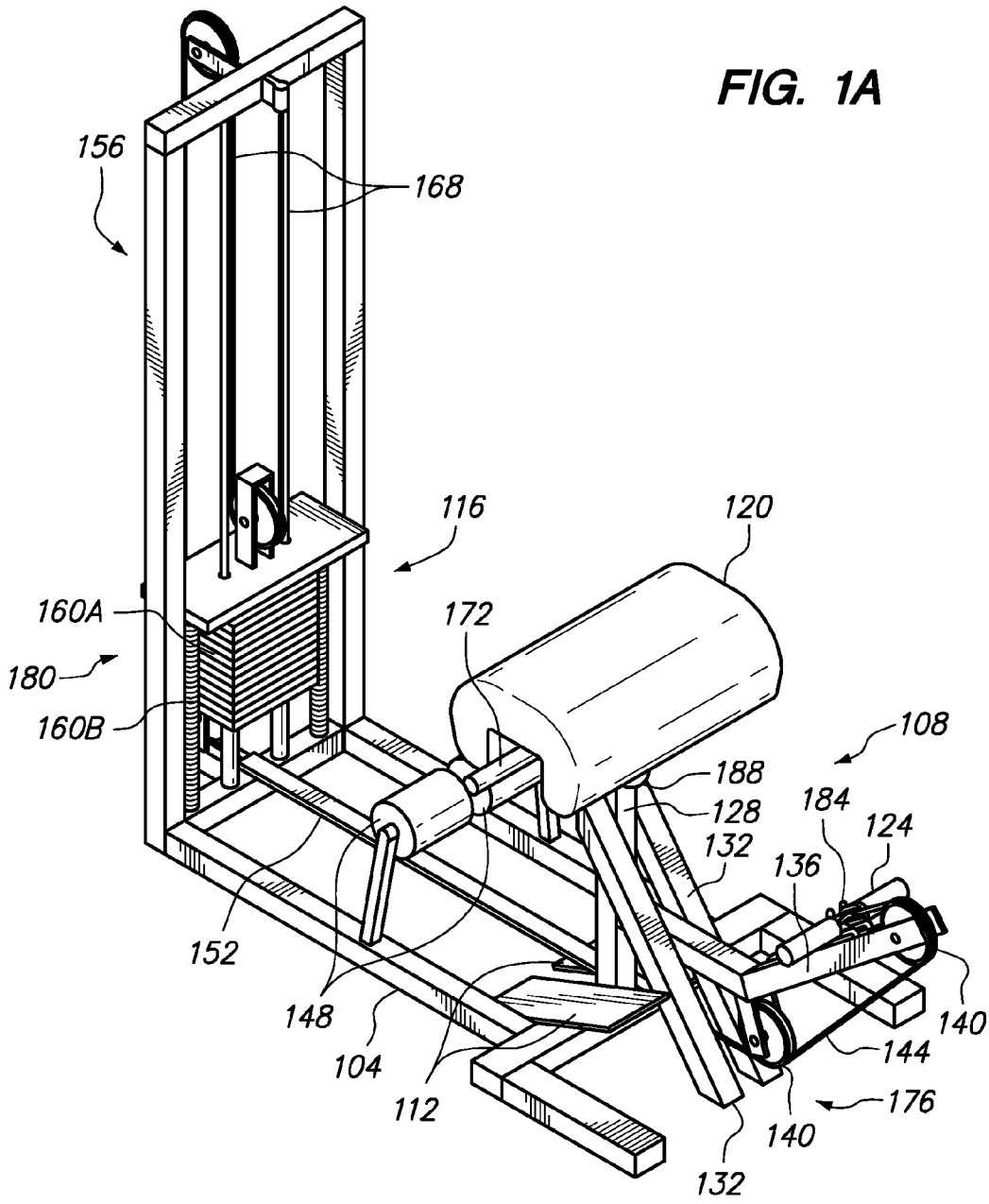
FIG. 1A is a perspective view of an exemplary lower back machine.

The lower back machine will now be described with regard to FIG. 1A. In general, a lower back machine comprises a brace 108 which helps prevent injury, and a resistance assembly 116 to provide a resistance to a user. The brace 108 and resistance assembly 116 may be secured to or supported by a frame 104. The frame 104 may also support other components of the lower back machine, as will be described further below. The frame 104 may be a rigid structure to provide stability to the components of the lower back machine. In one embodiment, such as shown, the frame 104 may comprise one or more members which contact the ground or floor. In this manner, the frame 104 may function as a base or foundation for the lower back machine. In the embodiment of FIG. 1A for example, the frame 104 comprises a rectangular structure for placement on the floor. The components of the lower back machine (such as the resistance assembly 116 and brace 108) may then be held stably by the frame 104.

In general, the brace 108 provides a structure which prevents certain body motions. In this manner, the brace 108 prevents injury to the user during training. For example, the brace 108 may comprise a pad 120 which accepts contact from a front portion of the user's body blocking further motion at the contact point. The brace 108 may have a front side and back side corresponding to the front portion 176 and back portion 180 of the lower back machine. Typically, the back side of the brace 108 will accept contact from the user, such as the user's waist or thigh area.

The pad 120 may be used to accept user contact and to improve user comfort in one or more embodiments. This allows the user to train for longer periods of time to achieve the results desired. As shown the pad 120 is a "U" shaped structure which presents a large padded surface to the user. Of course, the pad 120 may be a variety of shapes. For instance, the pad 120 may be planar, circular, rectangular, or square. It is contemplated that multiple pads 120 may be used in various embodiments.

The brace 108 may be positioned at a location which prevents the user from overextending his or her back during training. In this way, the brace 108 helps prevent injury during lower back training. This is in contrast to traditional lower back exercise devices which rely upon the user to not injure him or herself As shown in FIG. 1A for example, the brace 108 may be held or positioned at an elevated location. In one or more embodiments, the brace 108 may be near or at waist-height. For example, the brace 108 may be at the height of a user's waist or slightly above or below such that during training a front portion of the user's waist or thigh area contacts with the brace. This physical contact prevents further motion thus preventing the user's back from overextending backwards, as will be described further below.

One or more supports 128 may be used to hold or support the brace 108. For example, as shown the brace 108 is held at an elevated position by a support 128 comprising an elongated member extending upward from the frame 104. Of course, the support 128 may be various structures configured to secure the brace 108 at an elevated position. Additional supports 132 may be provided as well, such as to reinforce the supports 128 as well as to support other components of the lower back machine. It will be understood that the supports 128, additional supports 132, or both may be considered a part of the frame 104 in one or more embodiments.

In one or more embodiments, the brace 108 and/or pad 120 may be adjustable. For example, a support 128 may be configured to raise and lower the brace 108 to various heights. This allows users of different heights to utilize the lower back machine. In this manner, the brace 108 may be raised to at or near waist height of a taller user while lowered to at or near waist height for a shorter user. To illustrate, the support 128 may comprise a sleeve and tube structure where the tube is configured to slide within the sleeve. This allows the support 128 to be lengthened and shortened thus raising and lowering the brace, respectively. The sleeve, tube, or both may comprise one or more openings to accept a pin 188 or the like. Once at the desired position, the pin 188 may be inserted into an opening of the sleeve and the tube to secure the sleeve and tube relative to one another. Of course, other fasteners such as screws, clips, clamps, and the like may be used to secure the sleeve and tube relative to one another. It will be understood that, in adjustable embodiments, the support 128 may comprise various structures which allow the brace 108 and/or pad to be raised and lowered and secured in position.

The brace 108 may also be replaceable in one or more embodiments. For example, a worn or damaged brace 108 may be replaced with a new one. In addition, a brace 108 may be replaced for another brace with harder or softer padding. The brace 108 may also be configured for male and female users such as by including one or more indentations or open portions in the padding 120 to reduce pressure on the user. Thus, one brace 108 may be replaced for another brace depending on the user's gender. A brace 108 may also be replaced for another based on user preferences. For example, one user may prefer a "U" shaped brace 108 while another prefers a square or round brace. This improves the user's comfort and thus allows and encourages the user to train for longer periods of time.

The brace 108 may be removably secured to a support 128 in various ways. For example, removable fasteners such as screws, clips, pins, clamps, and the like may be used to removably secure the brace 108. In addition or alternatively, the brace 108 may be threaded onto a support 128. The embodiment of FIG. 1A includes a release handle 172 which makes it more convenient to remove and replace the brace 108. For example, the release handle 172 may be actuated or moved to engage and disengage a removable fastener. The release handle 172 may extend outward from the brace 108 to improve accessibility thus making releasing and replacing the brace easier for the user.

In one or more embodiments, the brace 108 may be at a front portion 176 of the lower back machine. The resistance assembly 116 may be at a back portion 180 of the lower back machine. In general, the resistance assembly 116 provides a resistance against the movement of the user's body. Typically, the resistance will be focused on the user's lower back and core muscles and body structures.

The resistance provided will typically be directed such that the resistance is applied to the motion of the user's upper body. For example, the resistance may be directed such that it resists motion of the user's upper body when the user bends at the waist or lower back area. Because the lower back muscles generate or "power" this type of upper body motion, the force of the resistance is applied to these muscles.

The resistance assembly 116 may be configured in a variety of ways. In one or more embodiments, the resistance assembly 116 may be configured in one embodiment such that the resistance provided has an angled force vector to the user's back or spine. This resistance, as will be discussed further below, enhances lower back training. In addition, in contrast to traditional lower back exercises (such as those utilizing free weights), the resistance does not compress the spine, reducing strain and the risk of injury to the user's back.

Figure 1B:
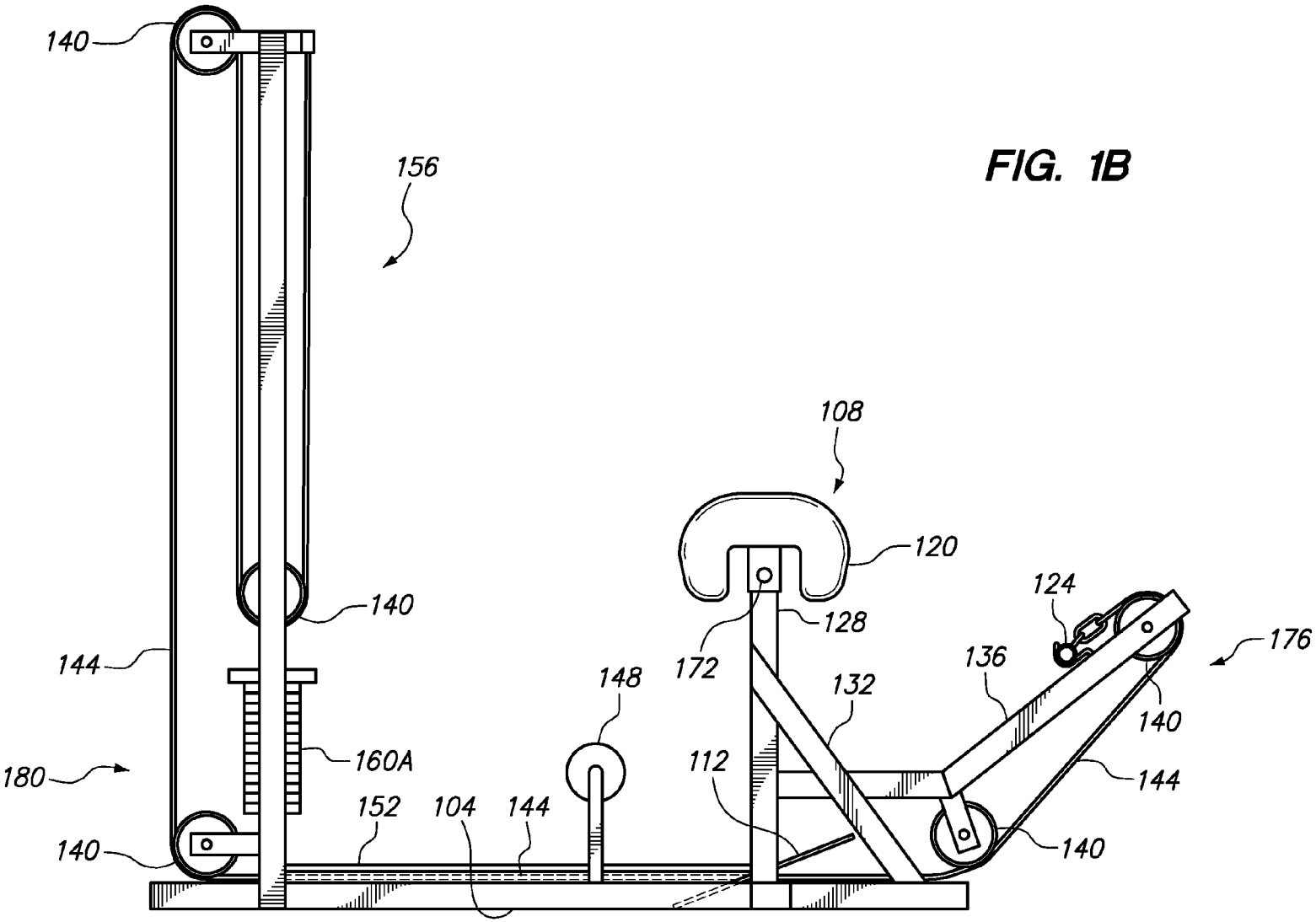
FIG. 1B is a side view of an exemplary lower back machine.

In one or more embodiments, the resistance may be provided through a cable 144 connected to a resistance device 156 which provides the force that makes up the resistance. For instance, as shown in FIG. 1B, the resistance device 156 may be a weight stack 160A which moves along a track 168. The weight stack 160A provides resistance through gravity which generates a downward force vector at the weight stack. The weight stack 160A may be connected to a cable 144 which transfers the force or resistance of the weight stack to a user. As can be seen, the cable 144 may be guided or positioned to alter the downward or other force vector(s) generated by the resistance device 156.

It will be understood that a variety of resistance devices 156 may be used with the training apparatus. In general, any device or structure capable of exerting a force may be used as a resistance device. Resistance may be fixed such as described above with regard to a weight stack 160A or may be variable. For example, one or more elastic bands, springs, flexible shafts, hydraulics, or the like may be used to provide variable resistance. Variable and fixed resistances may be combined. To illustrate, in FIG. 1A, the weight stack 160A is combined with springs 160B. The springs 160 enhance the resistance provided by the weight stack 160 and cause the resistance to be variable. It is contemplated that the resistance device 156, regardless of type, may be connected to a cable 144 to adjust its force vector such that it is directed forward from the user, as discussed herein.

Generally, a variable resistance is one that may increase or decrease as it is moved or stretched. For example, as a spring 160B is stretched, the amount of resistance it provides may increase. In contrast, a fixed resistance, such as a weight, remains constant as it is moved.

A user's strength may vary along a strength curve. For example, the strength of a muscle may increase as it contracts. In addition, the user's skeletal structure contains many fulcrum and lever structures (e.g., arms, legs, and their joints) that can make a resistance more or less easy to move depending on the position of these structures. In contrast to a fixed resistance, a variable resistance, in one or more embodiments, may increase with the user's strength curve. Though this is advantageous, it will be understood that the machine may be used with fixed resistance devices, such as the weights described above.

As can be seen from the embodiment of FIG. 1B, one or more pulleys 140 guide the cable 144 such that the force vector provided by the resistance device 156 is directed forward from the user. The force vector may be at various angles. For example, in FIG. 1B the cable and thus the force vector is angled downward from the user. The embodiment shown utilizes a particular number of pulleys 140 to transfer the force from the resistance device 156 to the user. Of course, other embodiments may utilize more or fewer pulleys. Pulleys 140 may be attached to various portions of the lower back machine. For example, the pulleys 140 may be attached to an extension 136, the frame 104, the resistance assembly 156 as well as other portions of the lower back machine. In general, the pulleys 140 may be positioned to guide the cable 144 to the user such that the cable does not rub against other portions of the lower back machine. This prevents damage to the machine as well as to the cable 144.

It is noted that pulleys 140 may not be required in all embodiments. For example, the resistance device 156 may be configured to provide resistance directly to the user at a force vector forward from the user, such as described herein. For example, one or more springs may be attached to the extension 136 and provide resistance (with a force vector oriented forward away from the user) directly to the user. Alternatively, other structures may be used in lieu of pulleys 140. For example, one or more low friction guides may be used to guide a cable 144 as desired.

To move the resistance provided by the resistance device 156, the user may engage the cable 144 and apply a force, such as through his or her lower back muscles, to the resistance device via the cable. Though the user may engage the cable 144 directly such as by grasping the cable, it is contemplated that a handle 124 or the like may be provided in one or more embodiments to allow the user to more easily or conveniently engage the cable. For example, a handle 124 may be attached to an end of the cable 144 to allow the user to easily engage the cable.

Figure 1C:
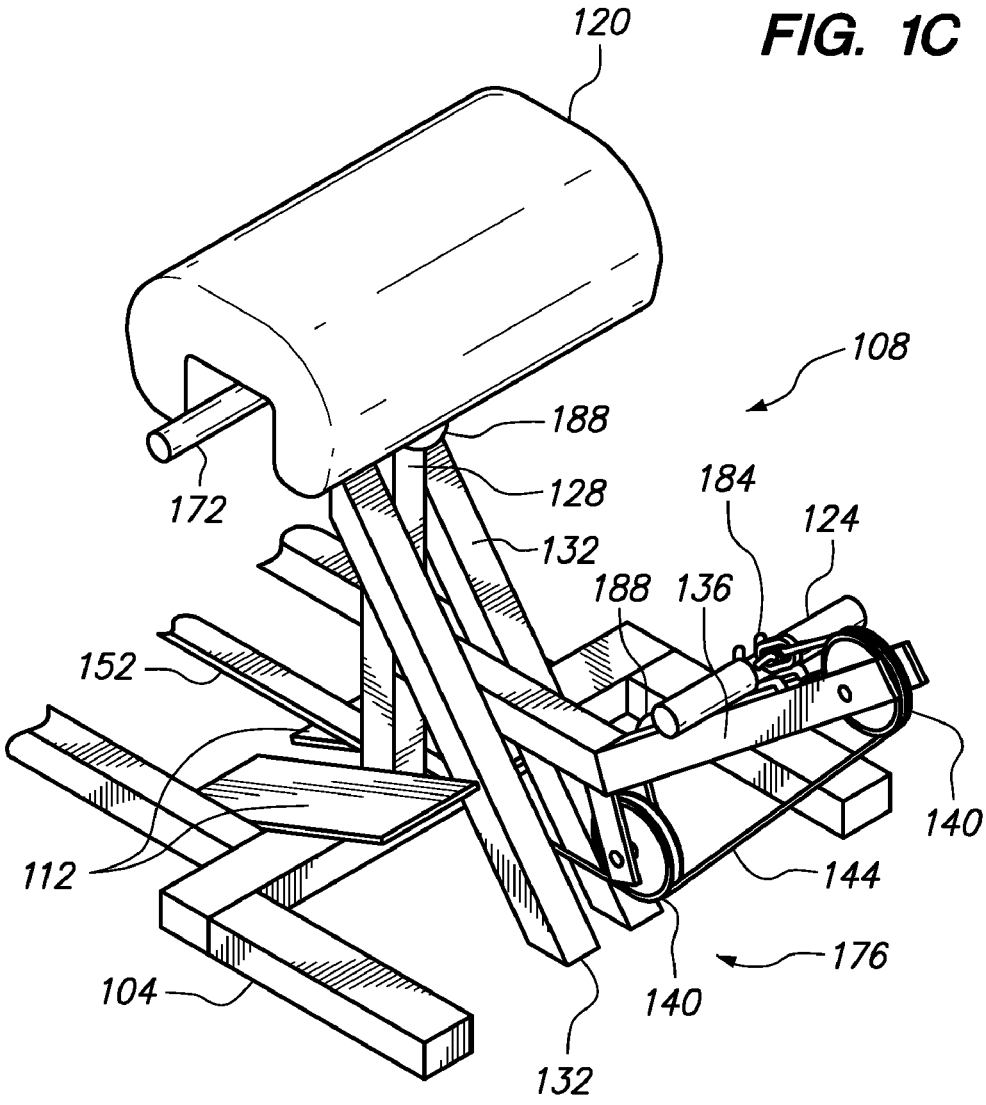
FIG. 1C is a perspective view of an exemplary brace of an example lower back machine.

The handle 124 may have a variety of configurations. As shown in FIG. 1C for example, the handle comprises a bar that the user may grasp. It is contemplated that the handle may have multiple sections such as a first section for the user's left hand and a second section for the user's right hand. The sections may be individually connected to the cable 144 or may be connected to one another and then to the cable. In one or more embodiments, the handle 124 may be padded or provide a grip to increase user comfort and grip on the handle.

In one or more embodiments, a cable holder 184 may be provided to store or support the cable 144 for convenient access. Proper storage of the cable 144 prevents the cable 144 from becoming damaged and reduces the risk of injury due caused by tripping or falling over the cable. In addition, storage of the cable 144 keeps the cable from becoming tangled.

An extension 136 may be provided at the front portion 176 of the lower back machine. In general, the extension 136 provides a supporting structure that allows resistance to be provided to the user from in front of the user. In this manner, the resistance may have a force vector directed away from the user from in front of the user. For example, the extension 136 may be an elongated member that extends outward at the front portion 176 of the lower back machine. One or more pulleys 140 may then be attached to the extension 136 to guide the cable 144 to the user from a location in front of the user (thus providing the desired force vector).

The extension 136 may be straight or include one or more bends, curves, or angles to locate the pulleys 140 at various elevations relative to the user. For example, as shown in FIG. 1C, the extension 136 comprises an upward bend that holds at least one pulley 140 at a raised position between the floor and the user's waist. In this manner, the cable 144 and corresponding force vector along the cable may be directed forward and downward relative to the user's lower back. As will be described below, this is advantageous in that this force vector continues to apply resistance to the user's lower back during portions of training where the user bends at the waist.

Though shown at one location, it is noted that the pulleys 140 may be located at other locations by the extension 136. For example, the extension 136 may be configured to hold at least one pulley 140 above the user's waist or at the level of the user's waist. Typically however, a force vector directed downward from the user's lower back will be desired and the pulleys 140 will typically be accordingly positioned.

It is contemplated that the extension 136 may be adjustable in one or more embodiments. This allows the pulleys 140 attached to the extension 136 to be located as desired by a user. For example, in FIG. 1C, the extension 136 may be configured to move forward (away from the user). This positions the pulleys 140 further away from the user. This is advantageous in that it extends the range of motion for taller users or for users with longer arms whose arms may otherwise reach beyond the length of the extension 136. Likewise, the extension 136 may be configured to move backward (toward the user), such as for shorter users or for users with shorter arms. This allows these users to easily grasp the handle 124 to begin training and to easily store the handle 124 at the cable holder 184 at the end of training. Otherwise the user may have to let go of the handle 124 causing the cable 144 and handle to be rapidly pulled into a neutral position by the resistance device. This is dangerous and may cause damage to the lower back machine.

A variety of structures may be used to allow forward and backward movement of the extension 136. For example, a sleeve and tube structure, such as described above with regard to the brace 108, may be used. In one or more embodiments, the extension 136 may be configured as the sleeve while a portion of the frame 104 or a support 128 is configured as the tube, or vice versa. The extension 136 may then slide or move relative to the frame 104 and be secured in position when the desired position is achieved. The sleeve and tube structure may include one or more openings which may be aligned to accept a pin 188 or the like to secure the extension 136 in position relative to the frame 104. As stated above, the sleeve and tube structure may also be secured by one or more screws, clips, clamps, and the like.

The extension 136 itself may be adjustable in one or more embodiments. For example, the extension 136 may include one or more pivots, such as hinges, which allow various portions of the extension 136 to bend. For example, a hinge could be located at the bend in the extension 136 illustrated in FIG. 1C. In this manner, the elevation of the uppermost pulley 140 may be adjusted thus also adjusting the force vector provided to the user. This is advantageous in that it allows the lower back machine to accommodate users of various heights. In addition, some users may not be able to bend as far down (such as due to injury or other reasons) as other users and thus may desire to raise the uppermost pulley 140 and the force vector.

As stated, the resistance device need not include a pulley and cable structure in all embodiments of the lower back machine. In embodiments without pulleys 140 a resistance device, such as one or more springs, elastic bands, or the like, may be attached at one end to the extension 136. For example, a spring or elastic band may be attached near or at the uppermost (or other) portion of the extension 136. The user may then engage the end of the resistance device, such as through one or more attached handles, to perform lower back exercises. In this manner, a force vector directed forward from the user and/or downward relative to the user's lower back may be provided by a variety of resistance devices without the need for pulleys 140.

The extension 136 may extend from various portions of the lower back machine. For instance, as shown, the extension 136 extends from a support 128 and may be reinforced or further held in position by one or more additional supports 132. It will be understood that the extension 136 may extend from various portions of the frame 104 in one or more embodiments if desired.

The extension 136 may comprise a cable holder 184 in some embodiments. The cable holder 184 may be configured to hold an end of the cable 144 in position relative to the extension 136. In this manner, the cable 144 may be safely stored when not in use. In addition, the cable 144 is then easily accessible. As can be seen in FIG. 1C, the cable 144 is held within convenient reach of the user. In one embodiment, such as that shown, the cable holder 184 may be configured to hold a handle 124 of the cable 144. It is contemplated that the cable holder 184 may also be configured to prevent the resistance device from pulling the cable 144 beyond a pulley 140 when not in use. In these embodiments, the cable holder 184 also functions as a stop for the handle 124 and attached cable 144.

FIG. 1C also illustrates two foot supports 112 that may be provided in one or more embodiments to support one or more of the user's feet. For example, a foot support 112 may be configured as a planar structure in one or more embodiments to allow a user to stand on the foot support 112. Multiple foot supports 112 may be provided in some embodiments. For example, there may be a foot support 112 for each of the user's feet, such as shown in FIG. 1C. Alternatively, a single foot support 112 may be provided for both of the user's feet. It is noted, that though beneficial, a foot support 112 need not be included in all embodiments as the user may stand on the floor.

In one or more embodiments, the foot supports 112 may be configured to support the user's feet in a particular position. For instance, the foot supports 112 may be angled in one or more embodiments, such as shown in FIGS. 1A-1C, to hold the user's feet at an angle. As will be described further below, this is beneficial in that it places the user's ankles at an ideal angle to support the users weight and the force of the resistance during training. In addition, the angle prevents the user from losing his or her footing relative to the foot supports 112, as will also be described further below. The angle of the foot supports 112 may be adjustable in one or more embodiments to allow a user to select his or her comfort or other preferences. In addition a steeper angle may be set where the user is working with a large amount of resistance to prevent the user from losing his or her footing. It is noted that the foot supports 112 may be parallel to the floor or ground in some embodiments.

It is contemplated that the foot supports 112 may include a retention structure in one or more embodiments. For example, the foot supports 112 may comprise one or more straps, blocks, or cupping structures which prevent the user's feet from moving forward during training. To illustrate, the user may strap in his or her feet or may engage a block or cupped portion of a retention structure with a front portion of his or her feet. In this manner, the retention structures of the foot supports 112 physically prevent the user's feet from moving forward by securing the user's feet. In embodiments with retention structures, it is contemplated that the foot supports 112 may be angled at smaller angles or not at all. The foot supports 112 may also have a textured surface to improve the user's grip to help the user keep his or her footing.

Figure 1D:
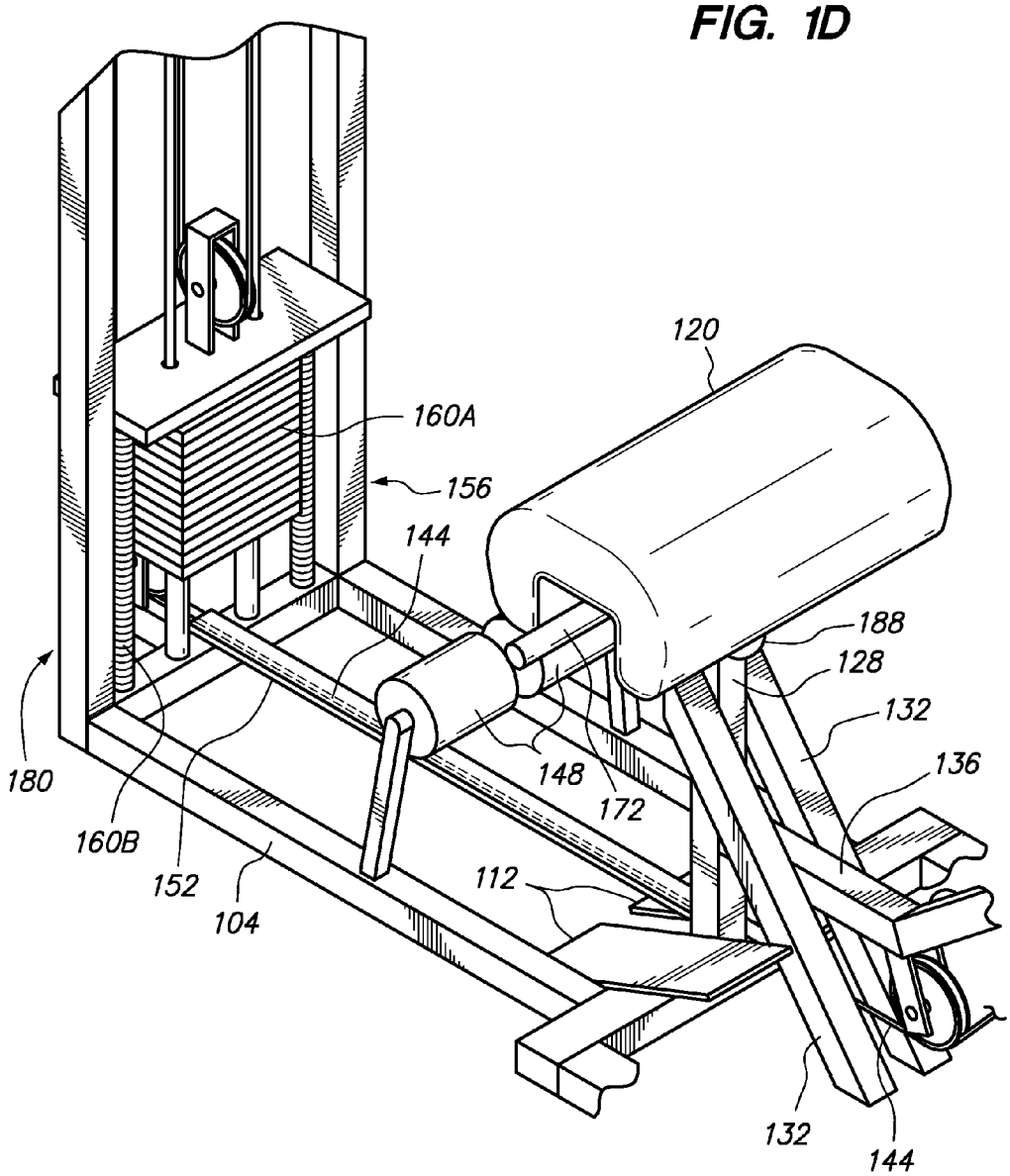
FIG. 1D is a perspective view of a portion of an exemplary lower back machine.

The lower back machine may also include one or more stops 148 in one or more embodiments. The stop 148 may extend from the frame 104 such as on a riser or other support. One or multiple stops 148 may be provided. For example, a stop 148 may be provided for each of the user's leg as shown in FIG. 1D. Alternatively, a single stop 148 may extend to contact both of the user's feet, ankles, or legs.

In general, the stops 148 are configured to provide an indication of when the user should reverse direction during training. As will be described below, the user may bend at the waist and lean the lower body backward during training. Once the user feels contact with a stop 148, he or she may reverse direction to continue training. Of course, the stops 148 also may physically prevent backwards rotation or movement of the user beyond a particular position. In this manner, the user is prevented from moving too far backwards and thus is prevented from injury such as from overextending or from leaning too far back such that the user begins to lose his or her balance or actually loses his or her balance.

It is contemplated that the stops 148 may be adjustable in one or more embodiments. For example, the stops 148 may be attached at various locations along the frame 104. In this manner, the user may adjust how much he or she is permitted to lean or move back during training. In addition, the stops 148 of various heights may be used such as to contact various portions of the user's body to indicate to the user that his or her direction should be reversed or to physically stop the user from moving any further back. For example, the stops 148 of FIG. 1D may contact the user's lower legs or ankles, but could be raised 148 (or replaced with taller stops) to contact the user's legs at a higher location. In addition, the stops 148 could be raised to contact at or near the user's posterior as the user bends over during training. The raised position is advantageous in that the stop(s) 148 could be configured as a seat or other support to allow a user to rest between exercises in a seated or leaning position with the stops 148 supporting the user's weight.

As shown, the stop 148 may be padded in one or more embodiments. In this manner contact with the stop 148 does not cause injury and is comfortable for the user. For example, the user may train on the lower back machine while a back portion of his or her leg, foot, or ankle is in contact with the stop 148. It is noted that a stop 148 is not required and thus need not be provided in all embodiments.

Referring back to FIGS. 1A-1B, it can be seen that the cable 144 may run from a back portion 180 of the lower back machine to a front portion 176 of the lower back machine. The cable cover 152 may be configured to protect the cable 144 from damage as well as to prevent the user from coming into contact with the cable, especially while training. This is highly advantageous in that it reduces the risk of injury to the user especially because the cable 144 will be moving during training. It is contemplated that in one or more embodiments, the cable cover 152 may also guide the cable from one portion of the lower back machine to another.

As can be seen, the cable 144 may run along the frame 104 near the user's feet where the user may accidentally contact the cable or where the cable may inadvertently rub against the user's leg, ankle, or foot, causing injury. The cable cover 152 may be configured to surround at least a portion of the cable 144. For example, as shown in FIG. 1D, the cable cover 152 comprises a tubular structure which encloses/surrounds the cable 144 as it runs along the length of the frame 104. The cable cover 152 may be a variety of shapes and sizes. For example, the cable cover 152 of FIG. 1D is rectangular. However, cable covers 152 may be round, square or other shapes. In addition, it is contemplated that the cable cover 152 may be integral with the frame 104 in some embodiments. For example, the cable 144 could run internally through a member or other portion of the frame 104.

The cable cover 152 need not fully surround the cable 144 in all embodiments. This is because it may be extremely difficult or impossible to come into contact with the cable 144 from particular angles. For instance, in FIG. 1D, it could be that only the top and/or sides of the cable 144 are covered by the cable cover 152 because it would be virtually impossible to come into contact with the cable 144 from below in that embodiment.

It is noted that one or more cable covers 152 may be used at various locations of the lower back machine to prevent contact with the cable 144. For example, a cable cover 152 may prevent contact with the cable 144 at the resistance device at a back portion of the lower back machine. A cable cover 152 may also include internal pulleys or other guide structures to guide the cable 144 when it is within the cable cover 152, to prevent damage to the cable when it is within the cable cover, or both. Such guide structures also allow the cable cover 152 to guide the cable allowing the cable cover to be curved, bent, or angled if desired.

Figure 2A:
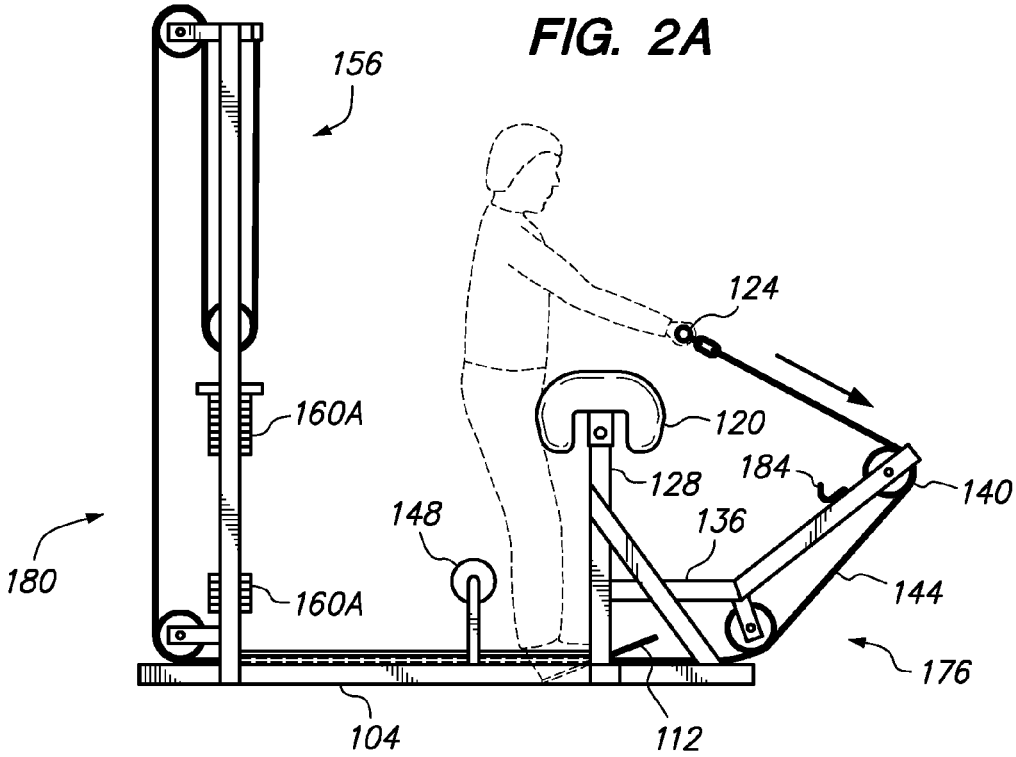
FIGS. 2A-2C illustrate exemplary lower back exercises performed on an example lower back machine.

Operation of the lower back machine will now be described with regard to FIGS. 2A-2C. The user may stand on the foot supports 112 and engage the cable 144 such as by grasping its handle 124. In one or more embodiments, the user may lean forward over the brace 108 to reach the handle 124. Once the handle 124 is in hand, the user may pull the handle 124 and attached cable 144 and stand upright such as shown in FIG. 2A. A resistance may be applied to the user via the cable 144 in this position. The arrow adjacent the cable 144 shows the direction of the force vector along the cable.

After engaging the cable 144, the user may then begin one or more lower back exercises. As shown in FIG. 2B, the user may move from a standing or upright position to a bent position. For example, the user may bend forward at the waist while leaning backward on his or her feet. This moves the user's waist area away from the brace 108 while moving the user's upper body towards the extension 136. The user may keep his or her arms extended while performing this motion. As can be seen in FIG. 2B, this stretches the users back which is beneficial in reducing back pain and strengthening and toning the lower back muscles.

In the bent position, the user typically does not, but may contact the brace 108. For example, it is contemplated that the user may bend the upper body forward until the upper body contacts a portion, such as a top portion, of the brace 108. Having no contact with the brace 108 in the bent position is beneficial in that it prevents the user from utilizing the brace to support or hold the resistance of the resistance device. This enhances the user's training and better stretches the user's back, namely the user's lower back.

The resistance provided by the resistance device 156 may be applied to the user as he or she moves to the bent position. As can be seen, the weight stack 160A of the resistance device 156 moves downward as the user moves to the bent position. In embodiments with springs (or the like), the springs may be elongated or stretched as the user moves to the bent position. Thus, in moving from an upright or standing position to the bent position of FIG. 2B, the user must resist the force of the resistance applied via the cable 144 that pulls the user towards the extension 136. In this manner, the user's muscles and other body structures (e.g., tendons, ligaments, bones, joints, etc. . . . ) are strengthened and toned by resisting the force of the resistance.

In general, the muscles used to resist this force are those of the lower back. Other muscles and body structures associated with the movement to the bent position are also strengthened and toned. For example, the user's core muscles and body structures are benefited. In addition, the user's legs and arms may also undergo some training in respectively supporting the user's weight and holding the resistance relative to the user (by the user holding the cable).

Figure 2B:
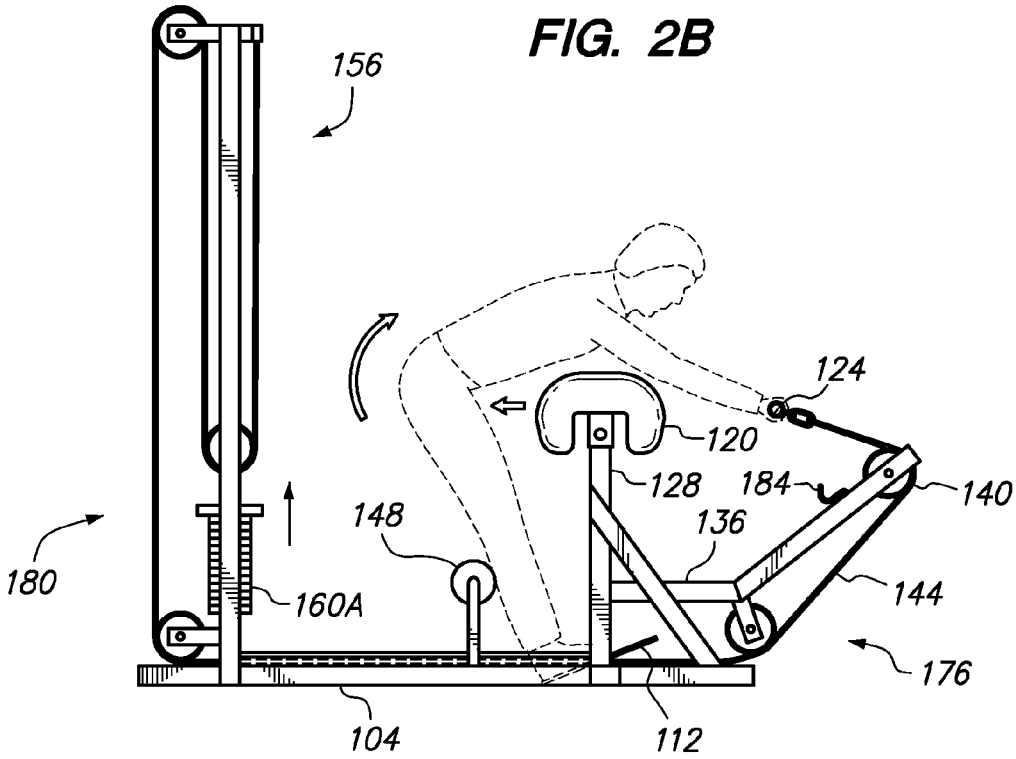

As can be seen from FIG. 2B, foot supports 112 allow the user to lean his or her lower body backward while his or her upper body bends forward. The foot supports 112 may be angled and/or textured to help the user keep his or her footing. In this manner, the user stays in position on the foot supports even though the resistance via the cable 144 is pulling the user forward. In one embodiment, the angle of the foot supports 112 reduces the effect of the horizontal pull of the resistance by redirecting at least some of the horizontal force downward. The angle of the foot supports 112 also allow the user's feet to be at or near perpendicular to the user's legs. In this manner, the user's ankles are well positioned to support the user's weight and to help the user apply a force against the resistance. As stated, foot supports 112 need not be provided in all embodiments. However, without foot supports 112 it may be more difficult for the user to maintain his or her footing when training.

The user may continue leaning his or her lower body back while bending the upper body forward until the user contacts the stop 148. For instance, as shown in FIG. 2B, the user's legs have contacted the stop 148. This indicates to the user that he or she may stop the backwards lean of his or her lower body. The user may continue to lean his or her upper body forward if desired. Alternatively, once the user has contacted (or is stopped by) the stop 148 the user may then move back to the standing or upright position as shown in FIG. 2C.

As can be seen the stop 148 may be used to define the extent to which the user leans in the bent position. To illustrate, by moving the stop 148 further back the user may lean more before contacting the stop 148. By moving the stop 148 forward the user may lean less before contacting the stop 148. The amount of permitted leaning may also be adjusted by raising or lowering the height of the stop 148 in addition to or instead of moving the stop forward or backward along the frame 104. As can also be seen, the stop 148 could be raised to the level of a user's thighs or posterior. In this manner, the stop 148 may function as a rest or seat upon which the user may sit or lean when taking a break from training.

Figure 2C:
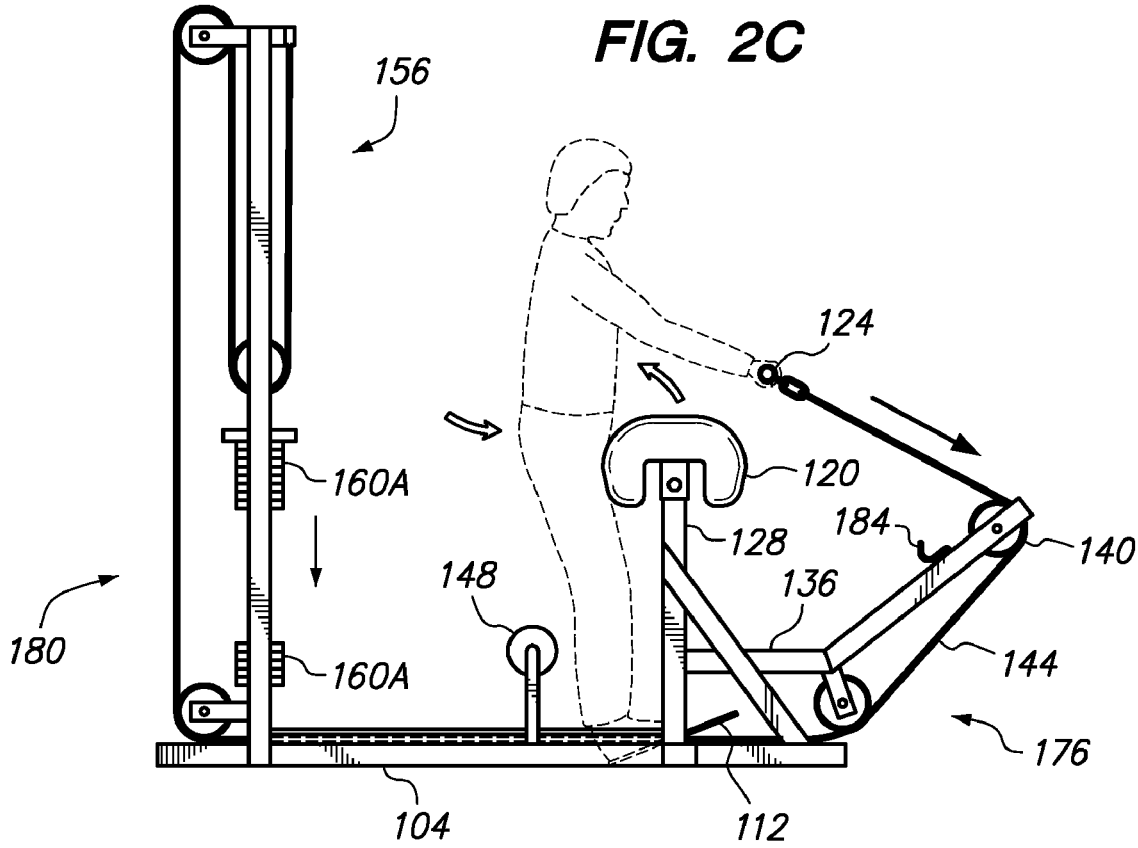

As FIG. 2C illustrates, to move to a standing position from the bent position, the user may extend at the waist rotating his or her torso upward, and moving his or her midsection towards the brace 108. In making this motion, the user may come into contact with the brace 108 at his or her midsection. This prevents the user from overextending the user's back by preventing the user from rotation once the user contacts the brace 108. In this manner, the user's back is protected from injury such as injuries related to overextending the user's back in a backwards direction.

In moving to the standing position, the user must overcome the resistance provided via the cable 144 and handle 124. As shown in FIG. 2C, this moves the weight stack 160A of the resistance device 156 upward as the user pulls the cable 144 by moving to the standing position. As illustrated by the arrow adjacent the cable 144 in FIG. 2C, the force vector remains directed forward of the user in a slightly downward angle. This is unlike traditional training devices which press or pull down on the user's spine causing undesirable compression of the spine.

Movement to the standing position is also powered by the user's lower back muscles as well as the user's other core muscles. Though the resistance is focused on the core and lower back muscles, the user also utilizes leg and thigh muscles as well as his or her arm muscles during this movement. Thus, these muscles are strengthened and toned as they overcome the resistance provided by the resistance device 156. In addition, associated body structures are also strengthened and toned in moving to the standing position.

As can be seen, the foot supports 112 continue to help the user keep his or her footing or position as the user moves to the standing position. The angle of the foot supports 112 makes it easier for the user to keep his or her footing despite the horizontal pulling force provided via the cable 144 as the user moves to the standing position. In addition, once the user is in the standing position, such as that shown in FIG. 2C, the angle of the foot supports 112 position the user's feet in an ideal position to move the user's body back to the bent position. For instance, the angle of the foot supports 112 prevent the user from losing his or her footing as the user leans his or her lower body backward while leaning his or her upper body forward. This is especially beneficial in that during this motion, the resistance provided via the cable 144 is pulling the user forward.

It is noted that the user may keep his or her arms in an extended position while training on the lower back machine, such as illustrated in FIG. 2C. This reduces the amount of energy the user must exert in holding the cable 144 and associated resistance. Thus, the user may perform lower back exercises for longer periods of time. In addition, this helps focus training on the lower back and core muscles and body structures. Moreover, as stated above, keeping the arms in an extended position allows the user to stretch his or her back especially when moving to the bent position. This can ease back pain as well as improve flexibility.

The user may perform one or more repetitions of moving between the standing position and the bent position. The user may also hold the bent position for a predetermined period of time, such as a few seconds, to continue stretching the back. In addition, the user may make one or more adjustments to the amount of resistance provided by the resistance device, and to the position of various adjustable components of the lower back machine (e.g., repositioning the pad, stop, or adjusting the force vector of the resistance) as described above. When a training session is complete, the user may lean forward and store the handle 124 back in the cable holder 184 for safe keeping.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A lower back exercise machine comprising:

a frame having a front portion and a back portion;

a brace supported by the frame, the brace having a front side and a back side, the back side configured to accept contact from a waist area of a user;

an extension at the front portion of the frame, the extension extending forward of the front side of the brace, the extension supporting a handle graspable by the user to convey resistance to the user;

one or more foot supports at a base portion of the brace; and wherein the one or more foot supports are angled upward towards the back portion of the frame.

2. A lower back exercise machine comprising:

a frame configured to support one or more components of the lower back exercise machine;

a brace at a front portion of the lower back machine, the brace elevated by the frame to accept contact from a front portion of a user to prevent overextension of the user's back;

a resistance device configured to provide a resistance to the user via a handle;

an extension extending forward at the front portion of the lower back machine, the extension supported by the frame and configured to hold the handle at a position in front of the user, wherein the handle presents the resistance to the user;

one or more pulleys supported by the extension; and wherein the frame is adjustable to raise and lower the brace.

3. A lower back exercise machine comprising:

a frame configured to support one or more components of the lower back exercise machine;

a brace at a front portion of the lower back machine, the brace elevated by the frame to accept contact from a front portion of a user to prevent overextension of the user's back;

a resistance device configured to provide a resistance to the user via a handle;

an extension extending forward at the front portion of the lower back machine, the extension supported by the frame and configured to hold the handle at a position in front of the user, wherein the handle presents the resistance to the user; and wherein the extension is configured to extend and retract at the front portion of the lower back machine to accommodate one or more users.

* * * * *